US006857992B1

(12) United States Patent
Kolda et al.

(10) Patent No.: US 6,857,992 B1
(45) Date of Patent: Feb. 22, 2005

(54) MAGNETIC RESISTANCE SYSTEM FOR A ROLLER-TYPE BICYCLE TRAINER

(75) Inventors: Clint D. Kolda, Cottage Grove, WI (US); Peter V. Colan, Granger, IN (US)

(73) Assignee: Saris Cysling Group, Inc., Madison, WI (US)

( * ) Notice: Subject to any disclaimer, the term of this patent is extended or adjusted under 35 U.S.C. 154(b) by 0 days.

(21) Appl. No.: 10/436,652

(22) Filed: May 13, 2003

Related U.S. Application Data

(60) Provisional application No. 60/380,182, filed on May 13, 2002.

(51) Int. Cl.[7] ..... A63B 69/16
(52) U.S. Cl. ..... 482/61
(58) Field of Search ..... 482/51, 57, 60–63, 482/65, 903

(56) References Cited

U.S. PATENT DOCUMENTS 4,982,953 A * 1/1991 Makishi ..... 482/61
5,468,201 A * 11/1995 Minoura ..... 482/61
5,472,392 A * 12/1995 Haan et al. ..... 482/61
5,704,876 A * 1/1998 Baatz ..... 482/4

OTHER PUBLICATIONS

Airmet et al., Stationary Exercise Apparatus, May 9, 2002.*

* cited by examiner

*Primary Examiner*—Nicholas D. Lucchesi
*Assistant Examiner*—Tam Nguyen
(74) *Attorney, Agent, or Firm*—Boyle, Fredrickson, Newholm, Stein & Gratz, S.C.

(57) ABSTRACT

A roller-type bicycle trainer includes a frame and a series of rollers that are configured to support the wheels of the bicycle. At least one of the rollers is formed of electrically conductive material, e.g. aluminum, and a magnetic resistance arrangement includes one or more magnets that are spaced from the electrically conductive material in order to create an eddy current resistive force that resists rotation of the roller, upon rotation of the roller by operation of the bicycle. The magnetic resistance arrangement includes an adjustment feature for adjusting the position of the one or more magnets relative to the roller, to vary the strength of the eddy current resistive force and thereby the degree of resistance to rotation of the bicycle wheel.

25 Claims, 5 Drawing Sheets

FIG. 1
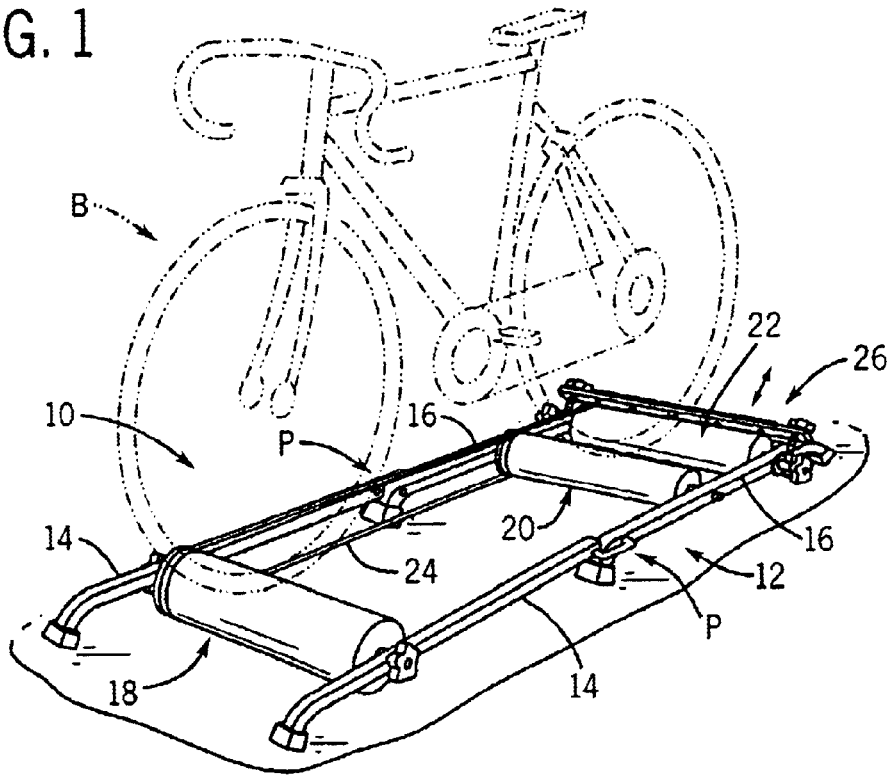
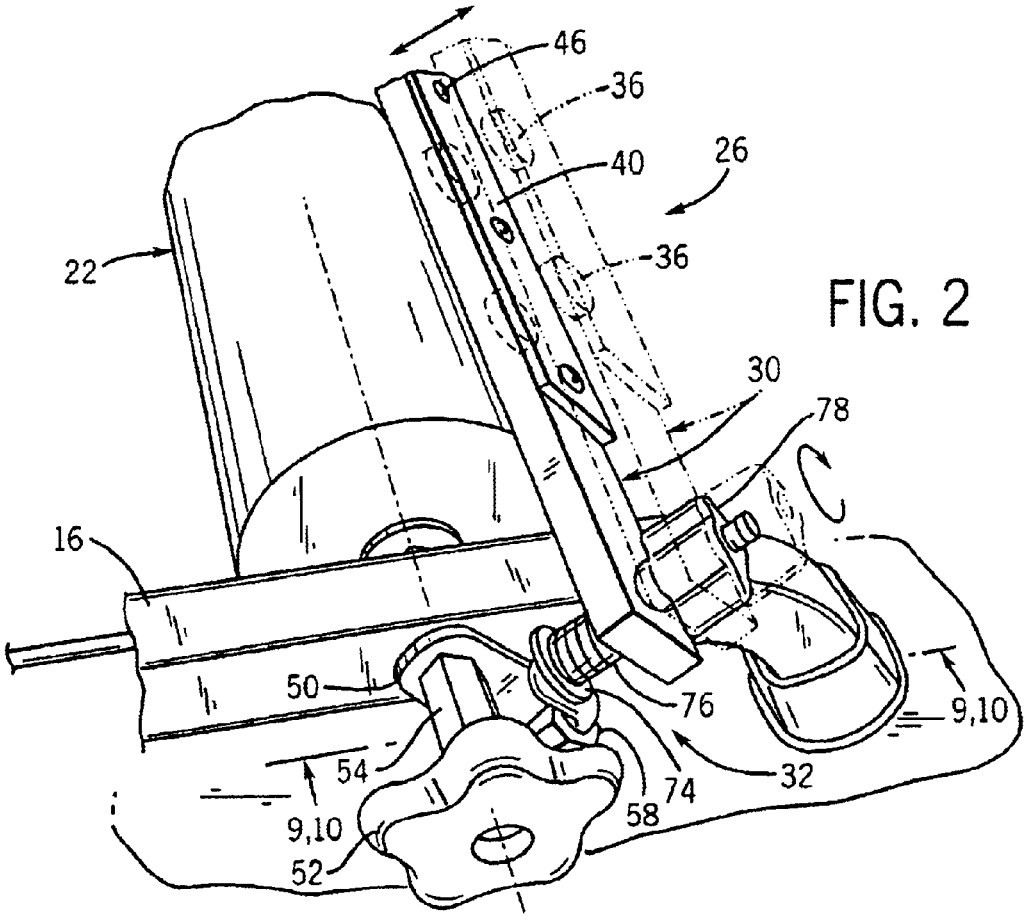
FIG. 2

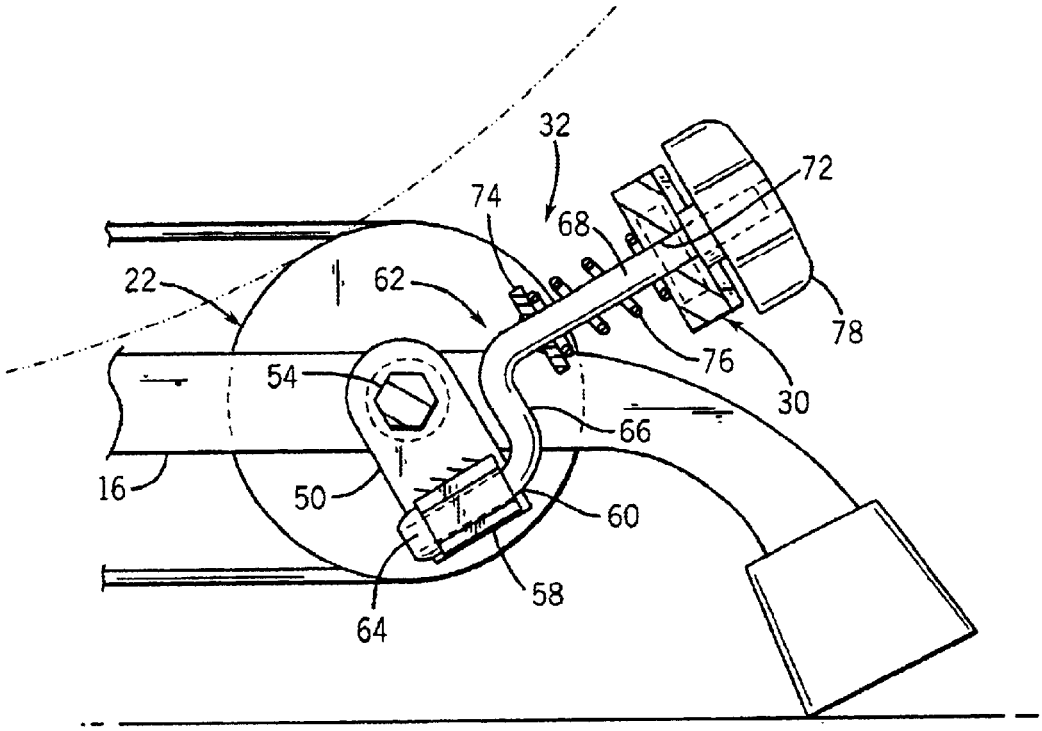
FIG. 9
FIG. 10
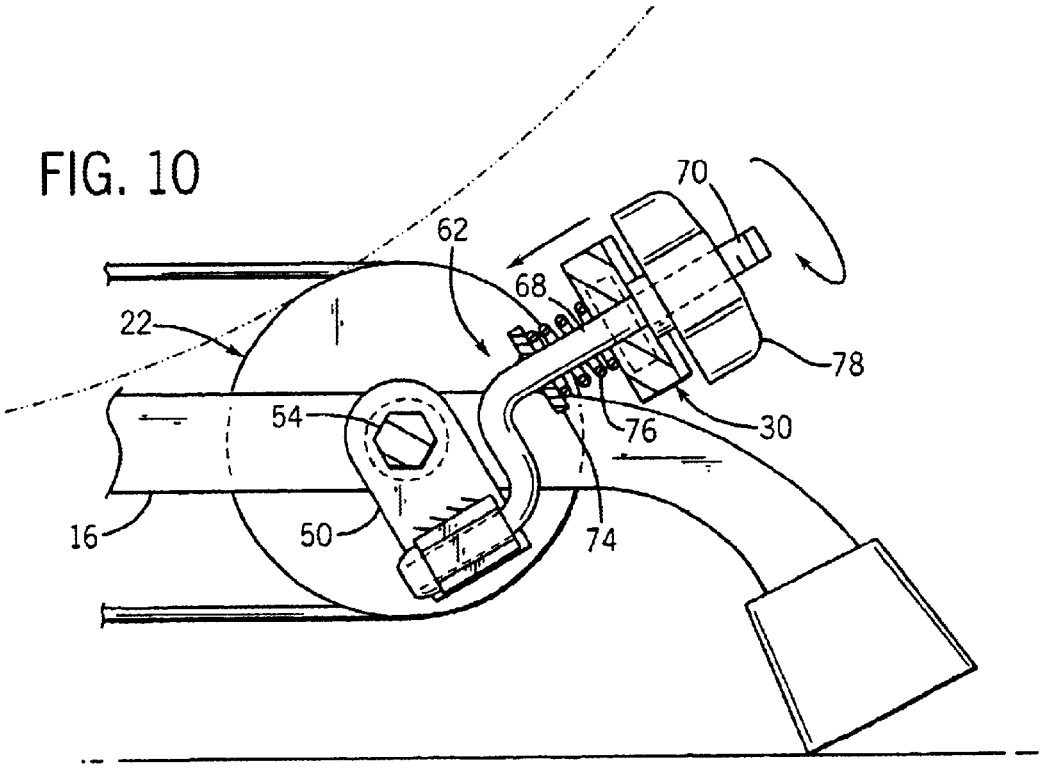

MAGNETIC RESISTANCE SYSTEM FOR A ROLLER-TYPE BICYCLE TRAINER

CROSS-REFERENCE TO RELATED APPLICATION

This application claims the benefit of U.S. Provisional Application Ser. No. 60/380,182, filed May 13, 2002.

BACKGROUND AND SUMMARY OF THE INVENTION

This invention relates to bicycle trainers, and more particularly to a stationary roller-type bicycle trainer having a resistance feature.

A roller-type bicycle trainer has a series of rollers that support the front and rear wheels of a bicycle. The user pedals the bicycle while maintaining the bicycle upright, to simulate the manner in which the bicycle is ridden outdoors. Typically, a single roller supports the front or non-driven wheel of the bicycle, and the rear or driven wheel of the bicycle is supported by a pair of rollers. The rear wheel rotates in response to operation of the bicycle pedals, which imparts rotation to the rollers with which the rear wheel is engaged. Rotation of one of the rear rollers is transferred to the front roller by means of a belt that extends between and is engaged with the rear roller and the front roller.

In a typical roller-type bicycle trainer, the only resistance to rotation of the bicycle wheels is provided by the friction of the rollers, which is minimal. The user is thus unable to increase the resistance beyond that which is provided by the friction of the rollers, and cannot vary the degree of resistance provided by the trainer.

It is an object of the present invention to provide a roller-type bicycle trainer having a resistance feature, to increase the resistance provided by the roller-type bicycle trainer which thereby enables a user to intensify a workout by increasing the amount of energy required to rotate the rollers. It is a further object of the invention to provide a resistance feature for a roller-type bicycle trainer that is capable of providing varying levels of resistance. Yet another object of the invention is to provide such a roller-type bicycle trainer that operates in the same manner as in the prior art, while incorporating a resistance feature. A still further object of the invention is to provide such a roller-type bicycle trainer in which the general construction of the trainer is the same as in the prior art, while incorporating a resistance feature. A still further object of the invention is to provide such a roller-type trainer having a resistance feature that is relatively simple in its components, construction and operation, yet which is highly effective in providing resistance to operation of a bicycle supported by the trainer.

In accordance with the present invention, a roller-type bicycle trainer includes a frame, and a roller arrangement mounted to the frame that is engageable by the wheels of a bicycle, for rotatably supporting the bicycle wheels relative to the frame. At least one of the rollers of the roller arrangement includes electrically conductive material. A magnetic resistance arrangement includes one or more magnets that interact with the electrically conductive material, so as to induce an eddy current resistive force on the roller upon rotation of the roller, which resists rotation of the roller and thereby provides resistance to the user of the bicycle.

The electrically conductive material may be the material that forms the surface of the roller, and may be any satisfactory electrically conductive material such as aluminum.

The magnetic resistance arrangement may be in the form of a magnet mounting member that is interconnected with the frame of the roller, and is radially spaced outwardly from one of the rollers. The mounting member extends across the surface of the roller, and includes spaced apart magnets that are located radially outwardly from the surface of the roller. The mounting member is preferably interconnected with the frame of the roller-type trainer via an adjustment arrangement, by which the radial spacing of the mounting member relative to the surface of the roller can be adjusted, so as to vary the spacing of the magnets from the roller surface. The adjustability or variation in the spacing of the magnets from the roller surface functions to control the strength of the eddy current forces that are established upon rotation of the roller, to vary the degree of resistance provided by the magnets upon rotation of the roller.

The invention contemplates a roller-type trainer incorporating a resistance feature, as well as an improvement in a roller-type trainer and a method of resisting rotation of a roller in a roller-type trainer, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of a roller-type bicycle trainer incorporating a resistance feature in accordance with the present invention;

FIG. 2 is a partial isometric view showing one of the rollers in the roller-type bicycle trainer of FIG. 1, and a portion of the magnet mounting member forming a part of the resistance feature of the present invention;

FIG. 9 is a partial section view with reference to line 9—9 of FIG. 2, showing the magnetic mounting member in a first position providing a lesser amount of resistance to roller rotation;

FIG. 10 is a view similar to FIG. 9, showing the magnetic mounting member moved inwardly toward the roller to increase resistance to rotation of the roller.

DETAILED DESCRIPTION OF THE INVENTION

Figure 3:
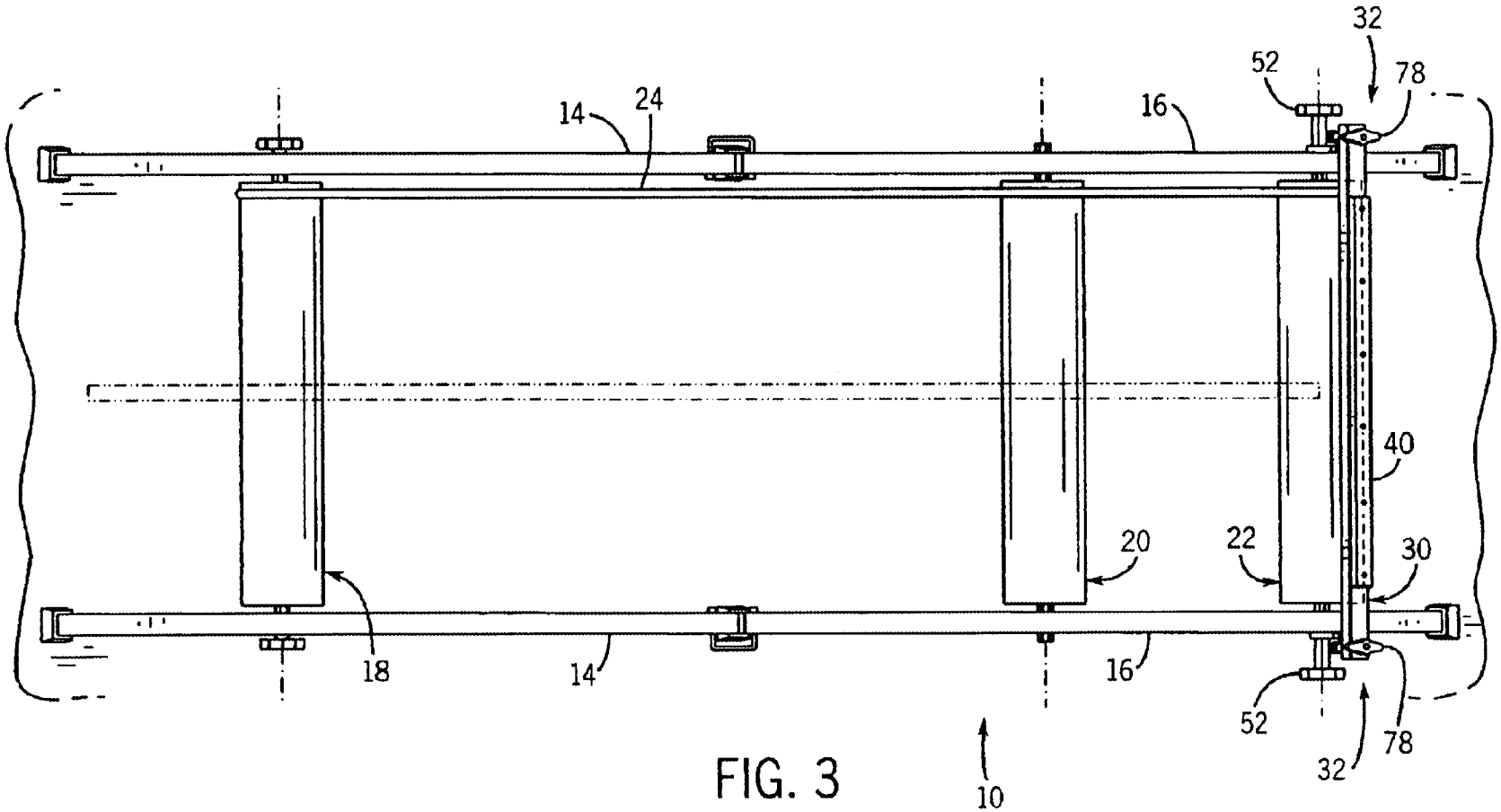
FIG. 3 is a top plan view of the roller-type bicycle trainer of FIG. 1.
Figure 4:
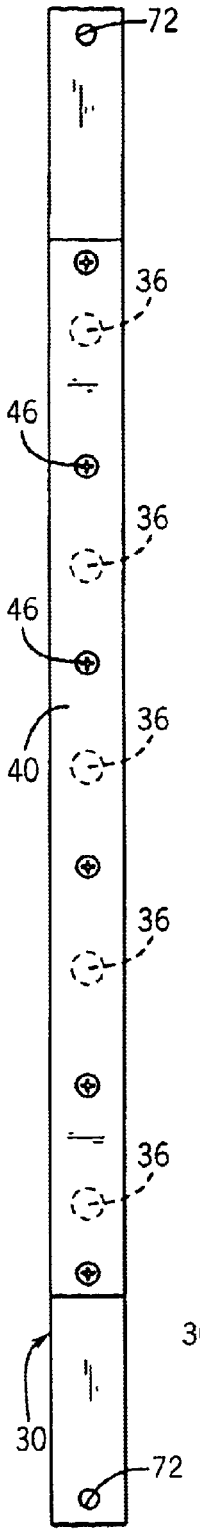
FIG. 4 is a top plan view of the magnetic mounting member forming a part of the resistance feature of the roller-type trainer of FIGS. 1 and 2.
Figure 5:
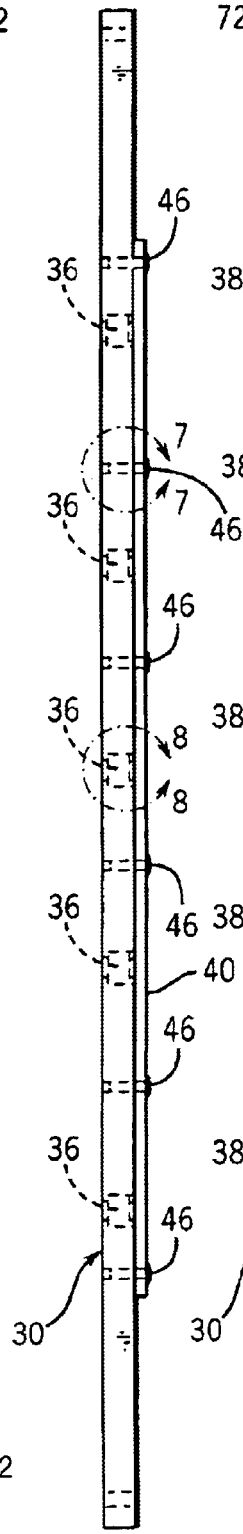
FIG. 5 is a side elevation view of the magnetic mounting member of FIG. 4.
Figure 6:
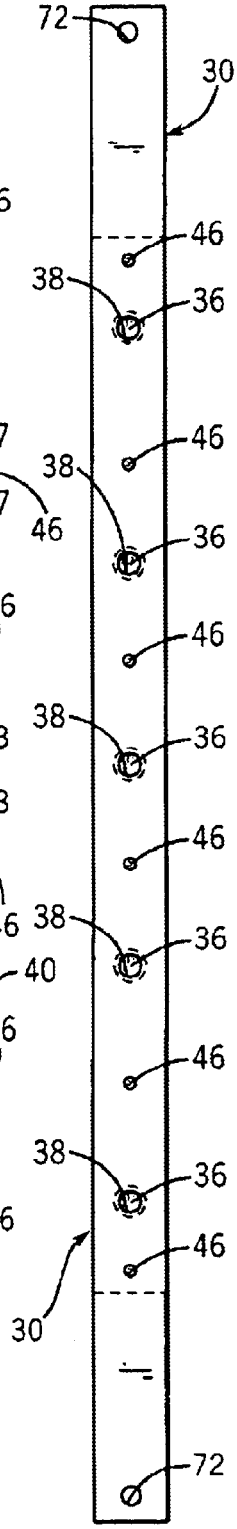
FIG. 6 is a bottom plan view of the magnetic mounting member of FIGS. 4 and 5.

As shown in FIGS. 1–3, a roller-type stationary bicycle trainer 10 includes a frame 12 having a pair of spaced apart front rails 14 and a pair of spaced apart rear rails 16. Front rails 14 and rear rails 16 are joined together by a pivot connection P, to enable trainer 10 to fold for storage. A series of cylindrical rollers extend between rails 14 and 16. The rollers include a front roller 18 and a pair of rear rollers 20, 22. In a known manner, the driven wheel of a bicycle B is adapted to be placed between rear rollers 20, 22 and the front wheel of bicycle B is adapted to be placed on front roller 18.

The illustrated construction of frame 12 is known in the art. It is understood that the illustrated construction of frame 12 is representative of any type of support frame which may be employed to support rollers 18–22, and that any other satisfactory frame construction may be employed.

In a manner as is known, a user pedals bicycle B so as to rotate the driven wheel of bicycle B, which is typically the rear wheel, and such rotation of the driven wheel causes rear rollers 20, 22 to rotate. A drive belt 24 is engaged with and extends between front roller 18 and rear roller 20, and functions to rotate front roller 18 in response to rotation of rear roller 20 to provide a user with the feel of an actual bicycle ride while remaining stationary.

A conventional roller-type stationary bicycle trainer having the same general construction and operation as trainer 10 is available from the CycleOps division of Graber Products, Inc. of Madison, Wis. under its Model Number 9501.

The present invention contemplates a resistance arrangement incorporated in bicycle trainer 10. The resistance arrangement is adapted to provide resistance to the rotation of one or more of the rollers of bicycle trainer 10, to increase the effort required to rotate the rollers and to thereby enhance the aerobic workout experienced by the user of bicycle trainer 10. Generally, the resistance arrangement of the present invention is of the magnetic type, which is relatively simple in its components and construction, and is thereby relatively low in cost while providing no additional moving parts to bicycle trainer 10.

In accordance with one version of the present invention as shown in FIGS. 1–3, a magnetic resistance device 26 is mounted to frame 12 of trainer 10 and interacts with one of the rollers, for resisting rotation of the roller. In the embodiment illustrated in FIGS. 1–10, the magnetic resistance unit 26 is in the form of a magnet mounting member or bar 30 that extends across frame 12 and is located adjacent the surface of one of the rollers, such as roller 22. Each end of magnet mounting member 30 is secured to one of frame members 16 via an adjustable mounting arrangement, shown generally at 32, which is operable to vary the radial spacing of mounting member 30 relative to the surface of roller 22. Referring to FIGS. 4–8, magnet mounting member 30 includes a series of spaced apart recesses 34 along its length, and a magnet 36 is located in each of recesses 34. An aperture 38 extends between the inner surface of magnet mounting member 34 and the inner end of each recess 34, to expose the inner surface of magnet 36. A retainer plate 40 overlies the outer surface of magnet mounting member 30, and functions to maintain magnets 36 within recesses 34. A resilient pad 42 is located between the inner surface of retainer plate 40 and the outer surface of each magnet 36, and functions to urge each magnet forwardly into engagement with the inner end of the recess 34 within which the magnet 36 is located.

Figure 7:
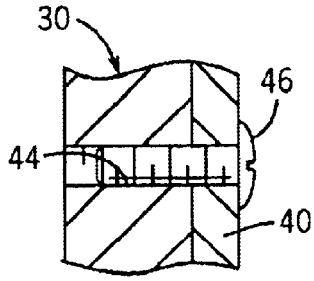
FIG. 7 is a partial enlarged section view, with reference to line 7—7 of FIG. 5.
Figure 8:
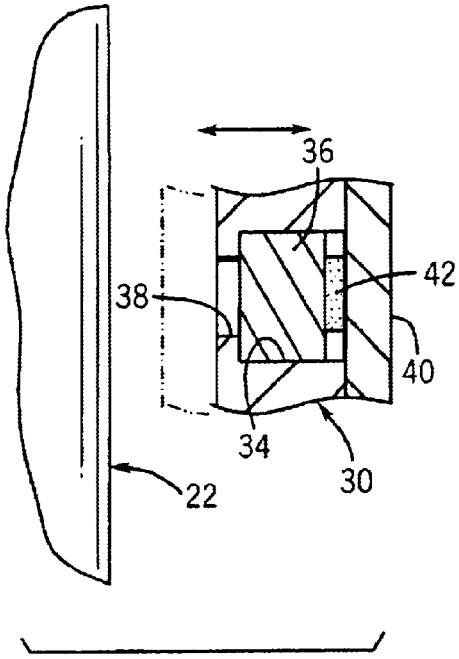
FIG. 8 is a partial enlarged section view, with reference to line 8—8 of FIG. 5.

As shown in FIG. 7, a series of threaded passages 44 are formed in magnet mounting member 30, and a threaded fastener 46 extends into engagement with each threaded passage 44 through an aligned passage formed in retainer plate 40. In this manner, retainer plate 40 is secured to magnet mounting member 30, and functions to maintain magnets 36 within recesses 34.

Referring to FIGS. 2, 9 and 10, each adjustable mounting arrangement 32 is engaged with one of the ends of magnet mounting member 30, and is operable to adjust the position of magnet mounting member 30 relative to the surface of roller 22. Each adjustable mounting arrangement 32 includes a mounting bracket 50 that is secured to frame member 16 via a screw-type mounting arrangement including a hand wheel 52 mounted to the end of an elongated nut 54, which is engaged with the treaded end of the axle of roller 22 that extends through frame member 16. The end of nut 54 engages the surface of mounting bracket 50, so as to sandwich mounting bracket 50 between the end of sleeve 54 and the surface of frame member 16. It is understood that this construction is illustrative, and that mounting bracket 50 may be retained on frame member 16 in any other satisfactory manner.

A receiver 58 is located at the outer end of mounting bracket 50, and an offset inner end portion 60 of a threaded adjustment member 62 is engaged with receiver 58. On one side of trainer 10, the receiver 58 is pivotable on the offset inner end portion 60 of adjustment member 62. In this manner, the bracket 50 can be pivoted about the inner end portion 60, to enable the bracket 50 to be positioned outwardly relative to the end of the axle of roller 22 and then pivoted toward frame 16 such that the outer portion of the axle of roller 22 is received in the opening in bracket 50. Offset inner end portion 60 includes an enlarged end 64, which cooperates with an intermediate bent area 66 of adjustment member 62 to maintain adjustment member 62 in engagement with bracket 50 in a predetermined angular orientation. Adjustment member 62 includes an outer end portion 68 that extends from intermediate area 66 and includes a series of threads 70. Outer end portion 68 is oriented so as to extend outwardly in a radial direction relative to the axis of rotation of roller 22, which is coincident with the location at which the inner end of mounting bracket 50 is engaged with frame member 16.

Outer end portion 68 of adjustment member 62 extends through an opening 72 formed in the end of magnet mounting member 30. A stop member 74 is mounted to outer end portion 68 of adjustment member 62, and a spring 76 bears between stop member 74 and the inner surface of magnet mounting member 30. A threaded receiver, in the form of a wing-type nut 78, is engaged with the threads 70 of outer end portion 68 of adjustment member 62, and defines an inner end that bears against the outer surface of magnet mounting member 30. With this construction, springs 76 urge magnet mounting member 30 outwardly, and magnet mounting member 30 can be moved inwardly against the force of springs 76 by rotation of nuts 78 on outer end portion 68 of adjustment member 62.

The outer wall area of roller 22 is formed of an electrically conductive material, e.g. aluminum, although it is understood that any other satisfactory electrically conductive material may be employed.

In operation, rotation of roller 22 caused by operation of bicycle B causes the electrically conductive material of the outer wall area of roller 22 to interact with the magnetic fields of magnets 34 so as to set up eddy currents in the vicinity of each magnet 34. The eddy currents thus created function to apply resistance to rotation of roller 22, and such resistance is thus transferred to the bicycle wheel to provide resistance to the user of bicycle B. The strength of such eddy current resistance is dependent on the strength of magnets 34 and the spacing of magnets 34 relative to the surface of roller 22. In this manner, the range of available resistance is controlled by the selected strength of magnets 34. The degree of resistance within the available range of resistance is then controlled by adjusting the position of magnets 30 relative to the surface of roller 22. This is accomplished by rotating the nuts 78 on the threaded outer end portions 68 of adjustment members 62, to move magnet mounting member inwardly against the force of springs 76 or outwardly under the influence of springs 76. Magnet mounting member can be moved between an inner position as shown in FIG. 10 and in solid lines in FIG. 2, to provide a maximum degree of resistance to rotation of roller 22, and an outer position as shown in FIG. 9 and in phantom lines in FIG. 2, to provide a minimum degree of resistance to rotation of roller 22. In addition, the user can remove magnet mounting member 30 from engagement with adjustment members 62 by removing nuts 78, to remove any resistance to rotation of roller 22. Alternatively, adjustment members 62 may have a length that is sufficient to allow magnet mounting member 30 to be moved outwardly relative to roller 22 to a position in which the spacing of magnets 36 relative to roller 22 is such that magnets 36 do not create eddy currents upon rotation of roller 22.

During normal operation, in which eddy current resistance results by the interaction of magnets 36 with the surface of roller 22, the eddy current energy is dissipated by first heating the material of roller 22. The heat of roller 22 is then dissipated by free and forced convection cooling from the surfaces of roller 22 that are exposed to ambient air in the environment of trainer 10.

In the illustrated embodiment, the user adjusts the spacing of magnets 36 from the surface of roller 22 by visually observing the distance of magnet mounting member 30 from the surface of roller 22. The user adjusts nuts 78 so as to create an even space across the length of roller 22, so that magnets 34 create uniform eddy currents across roller 22. In a refinement of this concept, nuts 78 may include a visual or tactile reference so as to ensure that each end of magnet mounting member 30 is spaced an equal distance from the surface of roller 22. Representatively, such a reference may include a stationary index mark on the outer surface of magnet mounting member 30, in combination with radially spaced indicia on nut 78 that which is selectively aligned with the index mark to set the position of magnet mounting member 30 relative to roller 22. For example, such visual indicia may be in the form of the numerals "1", "2", "3", etc. marked on the side of nut 78, that are placed in alignment with a line on magnet mounting member 30 to set the position of magnets 34 relative to roller 22. In this manner, the user sets both sides of magnet mounting member 30 to the same number, in order to provide uniform resistance across the length of roller 22. Alternatively, a tactile or audible position indicator may be associated with nuts 78, such as is shown and described in copending application Ser. No. 10/369,957 filed Feb. 20, 2003, the disclosure of which is hereby incorporated by reference. Alternatively, it is contemplated that a synchronous adjustment mechanism may be engaged with the ends of magnet mounting member 30, which provides a single operator interface and an adjustable mounting arrangement for synchronously adjusting both ends of magnet mounting member 30 to alter the spacing of magnets 34 relative to the surface of roller 22.

Alternatively, it is understood that magnet mounting member 30, or any other structure to which magnets such as 36 are mounted, may be positioned relative to roller 22 such that the magnets are closer to the surface of roller 22 at one end of roller 22 than the other. This construction provides adjustment of the resistive force primarily on one side of roller 22.

While the disclosed embodiment contemplates the entire outer wall of roller 22 as being formed of an electrically conductive material, it is understood that roller 22 may also be constructed so that electrically conductive material is located only in the vicinity of each magnet 34, e.g. by application of a coating of electrically conductive material to the surface of roller 22, which may otherwise be formed of a nonconductive material.

While magnet mounting member 30 is shown and described as being movable inwardly and outwardly via the threaded engagement of nuts 78 with adjustment members 62, it is understood that magnet mounting member 30 may also be movable inwardly and outwardly via any other satisfactory adjustable mounting arrangement that is capable of varying the spacing between magnet mounting member 30 and the surface of roller 22. It is also understood that magnets such as 36 need not necessarily be mounted to a mounting structure such as mounting member 30, and that magnets 36 may be mounted to any satisfactory mounting structure that is capable of mounting magnets 36 in spaced relationship to the surface of roller 22.

Figure 11:
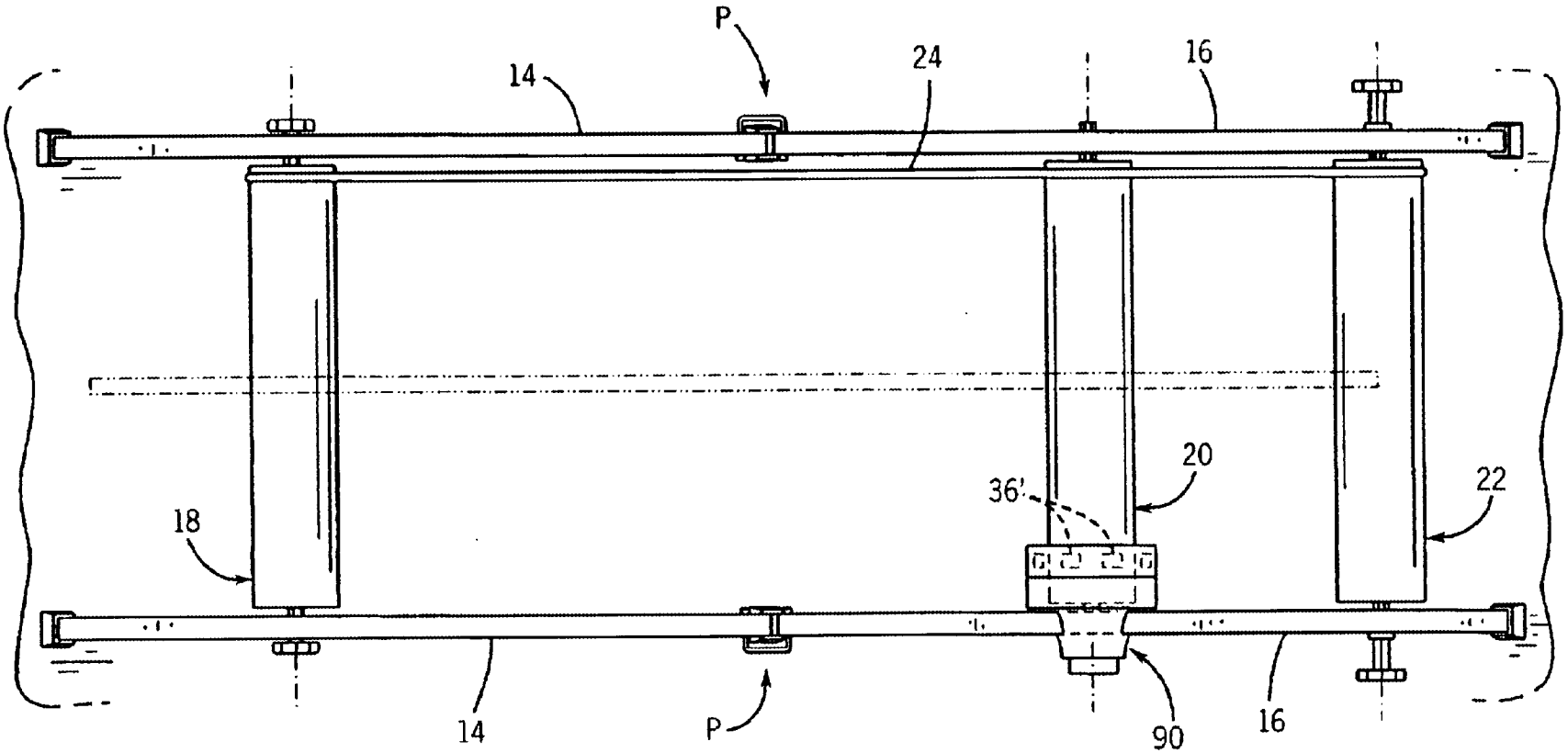
FIG. 11 is a top plan view of a roller-type bicycle trainer incorporating another embodiment of a resistance feature in accordance with the present invention.

FIG. 11 illustrates an alternative embodiment of the invention, in which a cup-shaped housing 90 is secured to one of frame side rails 16 in the vicinity of one of the rollers, such as roller 20. A series of magnets 36' are mounted to the interior of housing 90. Each magnet 36' is spaced outwardly from the outer surface of roller 20, and magnets 36' are radially spaced about the periphery of an internal cavity defined by housing 90. It is understood that housing 90 may take any satisfactory form capable of supporting magnets 36' in a radially spaced fashion outwardly of the outer surface of roller 20.

The end portion of roller 20 extends into the interior of housing 90, such that magnets 36' surround all or part of the end portion of roller 20. At least the end portion of roller 20 that extends into housing 90 is formed of an electrically conductive material, such as aluminum, although it is understood that any other satisfactory electrically conductive material may be employed. While the entirety of roller 20 is preferably formed of a similar material, e.g. aluminum, it is only required for purposes of the present invention that the end portion of roller 20 that extends into the interior of housing 90 be formed of the electrically conductive material, or that an electrically conductive coating or the like be applied to or carried by the end portion of roller 20.

In a manner similar to that described previously, rotation of the electrically conductive end portion of roller 20 within the interior of housing 90 interacts with the magnetic fields of magnets 36' so as to set up eddy currents in the end portion of roller 20. Such eddy currents function to apply resistance to rotation of roller 20, and such resistance is thus transferred to the bicycle wheel to provide resistance to the user. Again, the strength of such eddy current resistance is proportional to the strength of magnets 92 and the spacing of magnets 92 relative to the surface of roller 20 extending to the interior of housing 90, such that a desired degree of resistance can be attained by selecting the strength of magnets 92 and controlling the radial position of magnets 92 relative to the surface of roller 20. Magnets 92 may be mounted to housing 90 so as to be movable toward and away from the surface of roller 20, to provide adjustability in the resistance to rotation of roller 20.

It can thus be appreciated that the resistance device of the present invention provides a resistance feature to a roller-type trainer without adding any moving parts to the overall system. It can also be appreciated that the resistance unit of the present invention can be mounted to frame 12 of trainer 10 as shown, or can be mounted to any other structure associated with trainer 10 or to a structure separate from trainer 10, e.g. a floor-supported housing adapted for placement in the vicinity of the roller, such as 20 or 22, to provide resistance to rotation of the roller. Further, the resistance unit may be positioned so as to interact with any of the rollers of trainer 10. In addition, while the present invention has been shown and described with respect to mounting of magnets outwardly of the outer surface of the roller, it is also contemplated that the magnets may be mounted within the interior of the roller. In addition, while a particularly desired feature of the invention is the adjustability of the magnets relative to the roller surface to provide adjustability in the resistance to rotation of the roller, it is also understood that the magnets may be fixed in position to provide a fixed degree of resistance.

It is contemplated that various other types of arrangements may be employed for mounting one or more magnets that interact with an electrically conductive portion of a roller associated with a roller-type bicycle trainer, to set up eddy current resistive forces in the roller upon its rotation and to thereby provide resistance to the user of the trainer.

Various alternatives and embodiments are contemplated as being within the scope of the following claims particularly pointing out and distinctly claiming the subject matter regarded as the invention.

We claim:

1. A roller-type bicycle trainer, comprising:

a frame;

at least one rotatable roller mounted to the frame, wherein the roller is adapted to be engaged by a bicycle wheel and to support the bicycle wheel for rotation, wherein the roller includes a laterally extending wall, and wherein at least a portion of the wall includes an electrically conductive material; and a magnetic resistance arrangement, including one or more magnets that are radially spaced from and interact with the electrically conductive material, wherein the one or more magnets and the electrically conductive material are configured and arranged such that rotation of the roller induces an eddy current resistive force on the roller upon rotation of the roller caused by rotation of the bicycle wheel, to provide resistance to rotation of the roller and thereby to the user of the bicycle.

2. The bicycle trainer of claim 1, including at least a pair of rollers rotatably mounted to the frame, wherein each roller is arranged and configured to support one of the wheels of the bicycle.

3. A roller-type bicycle trainer, comprising:

a frame;

a pair of rotatable rollers mounted to the frame, wherein each roller is arranged and configured to rotatably support one of the wheels of the bicycle, wherein at least one of the rollers includes a wall that is engaged by the bicycle wheel, wherein the wall is formed of an electrically conductive material; and a magnetic resistance arrangement, including one or more magnets that are spaced outwardly from the wall and that interact with the electrically conductive material so as to induce an eddy current resistive force on the roller upon rotation of the roller, to provide resistance to rotation of the roller and thereby to the user of the bicycle.

4. The bicycle trainer of claim 3, wherein the magnetic resistance arrangement includes a support member that carries the one or more magnets, and wherein the support member is arranged so as to be radially spaced from the location at which the bicycle wheel engages the roller.

5. A roller-type bicycle trainer, comprising:

a frame;

at least one rotatable roller mounted to the frame, wherein the roller is adapted to be engaged by a bicycle wheel and to support the bicycle wheel for rotation, wherein at least a portion of the roller includes an electrically conductive material; and a magnetic resistance arrangement, including one or more magnets that are spaced from and interact with the electrically conductive material so as to induce an eddy current resistive force on the roller upon rotation of the roller, to provide resistance to rotation of the roller and thereby to the user of the bicycle, wherein the magnetic resistance arrangement includes an adjustment arrangement for varying the spacing between the one or more magnets and the electrically conductive material, to control the strength of the eddy current force established by rotation of the roller relative to the one or more magnets.

6. The bicycle trainer of claim 5, wherein the magnetic resistance arrangement includes a support member that carries the one or more magnets.

7. The bicycle trainer of claim 6, wherein the support member is mounted to the frame via an adjustable mounting arrangement that is configured and arranged for movement toward and away from a surface of the roller to vary the strength of the eddy current forces and thereby resistance to rotation of the roller.

8. The bicycle trainer of claim 7, wherein the adjustable mounting arrangement comprises a pair of threaded members interconnected with the frame, a biasing member interconnected with each threaded member and engaged with the support member for urging the support member outwardly relative to the surface of the roller, and a threaded receiver engaged with each threaded member, wherein rotation of the threaded receiver relative to the threaded member in a first direction is operable to move the support member toward the surface of the roller against the force of the biasing members, and wherein rotation of the threaded receiver in a second direction is operable to move the support member away from the surface of the roller under the influence of the biasing members.

9. The bicycle trainer of claim 1, wherein the one or more magnets are mounted to a housing interconnected with the frame, wherein the housing is configured such that the magnets overlie at least a portion of the surface of the roller that is formed of an electrically conductive material.

10. A method of resisting rotation of a roller in a stationary roller-type bicycle trainer having at least one roller that supports a wheel of the bicycle, comprising positioning one or more magnets adjacent to and radially spaced from a laterally extending surface of the roller that is formed of an electrically conductive material, and causing rotation of the roller by operation of the bicycle wherein the magnetic fields of the one or more magnets interact with the electrically conductive material of the laterally extending surface of the roller upon rotation of the roller to induce eddy current forces that resist rotation of the roller, to thereby resist rotation of the bicycle wheel supported by the roller.

11. A method of resisting rotation of a roller in a stationary roller-type bicycle trainer having at least one roller that supports a wheel of the bicycle, comprising positioning one or more magnets adjacent a surface of the roller that is formed of an electrically conductive material, causing rotation of the roller by operation of the bicycle so that the magnetic fields of the one or more magnets interact with the electrically conductive material of the roller so as to induce eddy current forces that resist rotation of the roller, to thereby resist rotation of the bicycle wheel supported by the roller, and adjusting the position of the one or more magnets relative to the roller so as to vary the eddy current forces in proportion to the spacing of the one or more magnets from the surface of the roller.

12. The method of claim 11, wherein the trainer includes a frame that supports the roller, and wherein the one or more magnets are mounted to a magnet support member that is interconnected with the frame via an adjustable mounting arrangement, wherein the act of varying the position of the one or more magnets relative to the roller is carried out by operation of the adjustable mounting arrangement.

13. The method of claim 10, wherein the act of positioning one or more magnets adjacent a surface of the roller is carried out by positioning the one or more magnets outwardly of an external surface of the roller.

14. In a stationary roller-type bicycle trainer including a frame and a plurality of rollers rotatably mounted to the frame, wherein the rollers are adapted to engage and rotatably support the wheels of a bicycle, the improvement comprising a magnetic resistance arrangement including one or more magnetic members radially spaced from an axially extending portion of at least one of the rollers that is formed of an electrically conductive material, wherein the one or more magnetic members interacts with the axially extending portion of the at least one roller formed of the electrically conductive material so as to establish eddy current resistance to rotation of the roller to provide resistance to rotation of the roller and thereby to the user of the bicycle.

15. The improvement of claim 14, wherein the magnetic resistance unit comprises a series of radially spaced magnets associated with a housing, wherein an end portion of one of the rollers extends into the housing and interacts with the magnets upon rotation of the roller so as to establish eddy current resistance upon rotation of the roller.

16. The improvement of claim 15, wherein the housing is interconnected with the frame of the roller-type bicycle trainer.

17. In a stationary roller-type bicycle trainer including a frame and a plurality of rollers rotatable mounted to the frame, wherein the rollers are adapted to engage and rotatable support the wheels of a bicycle, and wherein at least a portion of one of the rollers is formed of an electrically conductive material, the improvement comprising a magnetic resistance arrangement that interacts with the portion of the at least one roller formed of an electrically conductive material so as to establish eddy current resistance to rotation of the roller, wherein the magnetic resistance arrangement comprises an axial mounting member spaced outwardly from one of the rollers, and a series of axially spaced magnets mounted to the mounting member and spaced outwardly from an outer surface defined by the roller.

18. The improvement of claim 17, wherein the axial mounting member is interconnected with the frame of the bicycle trainer via an adjustment arrangement that enables the position of the axial mounting member, and thereby the series of axially spaced magnets, to be varied relative to the outer surface defined by the roller to vary the strength of the eddy current resistance.

19. In a stationary roller-type bicycle trainer including a frame and a plurality of rollers rotatable mounted to the frame, wherein the rollers are adapted to engage and rotatable support the wheels of a bicycle, and wherein at least a portion of one of the rollers is formed of an electrically conductive material, the improvement comprising a magnetic resistance arrangement that interacts with the portion of the at least one roller formed of an electrically conductive material so as to establish eddy current resistive forces that resist rotation of the roller, wherein the magnetic resistance arrangement includes one or more magnets, and wherein the position of the magnets relative to the roller is adjustable so as to vary the eddy current resistive forces experienced by the roller upon rotation of the roller.

20. The improvement of claim 19, wherein the magnets are mounted to a mounting member that is spaced from a surface of the roller, wherein the mounting member is interconnected with the frame of the roller-type bicycle trainer via an adjustable mounting arrangement that is configured and arranged to vary the position of the mounting member relative to the surface of the roller, to thereby vary the position of the magnets relative to the surface of the roller.

21. The improvement of claim 20, wherein the mounting member defines a pair of spaced ends, wherein the adjustable mounting arrangement includes a threaded member engaged with each end of the mounting member and interconnected with the frame of the roller-type bicycle trainer, a biasing member engaged with each threaded member and with the mounting member for urging the mounting member away from the roller, and a threaded receiver engaged with the threaded member for selectively moving the mounting member toward the roller against the force of the biasing member and for selectively allowing movement of the mounting member away from the surface of the roller under the influence of the biasing member.

22. A resistance arrangement for a roller-type bicycle trainer having a frame and a plurality of rollers rotatably supported by the frame, wherein the rollers are configured to support the wheels of a bicycle and are rotated upon rotation of the driven wheel of the bicycle, comprising at least a laterally extending portion of at least one of the rollers being formed of an electrically conductive material, and magnetic resistance means radially spaced from the electrically conductive material, wherein the magnetic resistance means and the electrically conductive material function to create an eddy current resistive force that resists rotation of the roller upon rotation of the roller in response to operation of the bicycle.

23. A resistance arrangement for a roller-type bicycle trainer having a frame and a plurality of rollers rotatably supported by the frame, wherein the rollers are configured to support the wheels of a bicycle and are rotated upon rotation of the driven wheel of the bicycle, wherein at least a portion of at least one of the rollers is formed of an electrically conductive material, comprising magnetic resistance means spaced from the electrically conductive material of the roller for creating an eddy current resistive force that resists rotation of the roller upon rotation of the roller in response to operation of the bicycle, wherein the magnetic resistance means includes adjustment means for varying the space between the magnetic resistance means and the electrically conductive material of the roller to vary the eddy current resistive force created upon rotation of the roller.

24. The bicycle trainer of claim 1, wherein the roller includes a wall that is engaged by the bicycle wheel, wherein the wall of the roller is formed of the electrically conductive material.

25. The bicycle trainer of claim 1, wherein the one or more magnets are spaced outwardly from the electrically conductive material.

* * * * *

UNITED STATES PATENT AND TRADEMARK OFFICE

CERTIFICATE OF CORRECTION

PATENT NO. : 6,857,992 B1
DATED : February 22, 2005
INVENTOR(S) : Clint D. Kolda et al.

It is certified that error appears in the above-identified patent and that said Letters Patent is hereby corrected as shown below:

Title page,
Item [73], Assignee, delete "Cysling" and substitute therefore -- Cycling --;

Column 8,
Line 57, after "bicycle" insert -- , --;

Column 9,
Line 30, before "roller" delete "at least one";
Line 44, delete "rotatable" and substitute therefor -- rotatably --;
Lines 45-46, delete "rotatable" and substitute therefor -- rotatably --;
Line 65, delete "rotatable" and substitute therefor -- rotatably --;
Lines 66-67, delete "rotatable" and substitute therefor -- rotatably --;

Signed and Sealed this

Nineteenth Day of July, 2005

JON W. DUDAS
*Director of the United States Patent and Trademark Office*